US012534270B2

(12) United States Patent
Gonzalez et al.

(10) Patent No.: US 12,534,270 B2
(45) Date of Patent: Jan. 27, 2026

(54) DISPENSING SPOUT FOR SOLID ITEMS

(71) Applicant: Optum, Inc., Minnetonka, MN (US)

(72) Inventors: Albo David Dominguez Gonzalez, Oviedo, FL (US); Bryan Michael Ciervo, Orlando, FL (US); Stephen Charles Bovenizer, Deltona, FL (US)

(73) Assignee: Optum, Inc., Minnetonka, MN (US)

( * ) Notice: Subject to any disclaimer, the term of this patent is extended or adjusted under 35 U.S.C. 154(b) by 387 days.

(21) Appl. No.: 18/062,654

(22) Filed: Dec. 7, 2022

(65) Prior Publication Data

US 2024/0190617 A1 Jun. 13, 2024

(51) Int. Cl.
*B65D 25/48* (2006.01)

(52) U.S. Cl.
CPC ..... *B65D 25/48* (2013.01)

(58) Field of Classification Search
CPC ..... B65D 25/48; B65B 37/10; B65B 39/00
See application file for complete search history.

(56) References Cited

U.S. PATENT DOCUMENTS

| | | | | |
|---|---|---|---|---|
| 1,042,785 A | | 10/1912 | Goulding | |
| 3,145,875 A | | 8/1964 | Medoff et al. | |
| 3,400,865 A | * | 9/1968 | Hester | A47J 36/14 222/475 |
| 3,516,580 A | * | 6/1970 | Hester | A47J 31/00 222/475.1 |
| 3,606,102 A | * | 9/1971 | Lowry | B65D 25/48 222/475.1 |
| 3,937,176 A | | 2/1976 | Nicholson et al. | |
| 4,344,549 A | * | 8/1982 | Paradis | A47G 19/12 222/475.1 |
| 5,484,089 A | * | 1/1996 | Picerno | B65D 83/04 222/536 |
| 6,370,215 B1 | | 4/2002 | Pinto et al. | |
| 6,497,339 B1 | | 12/2002 | Geltser et al. | |
| 6,966,453 B2 | | 11/2005 | Tian | |
| 7,870,973 B2 | | 1/2011 | Michelli et al. | |

(Continued)

FOREIGN PATENT DOCUMENTS

| | | | | |
|---|---|---|---|---|
| CN | 114056908 A | | 2/2022 | |
| GB | 2554052 A | * | 3/2018 | B65D 25/48 |
| WO | 2010/053369 A2 | | 5/2010 | |

OTHER PUBLICATIONS

"Tablet Chute Assembly (Chute & Deflector Strip)," Natoli, (3 pages), (Year: 2022), (article, online), [Retrieved from the Internet Sep. 7, 2022] <URL: https://natoli.com/product/tablet-chute-assembly-chute-deflector-strip/>.

(Continued)

*Primary Examiner* — Bob Zadeh
(74) *Attorney, Agent, or Firm* — Alston & Bird LLP

(57) ABSTRACT

An example dispensing spout for solid items includes a first body tube portion and a second body tube portion. The first body tube portion may comprise a slide portion. The second body tube portion may comprise a connection portion for connecting the dispensing spout onto a dispenser. The slide portion may comprise a slide surface extending from an open dispensing end to a distal slide end. Solid items dispensed by the dispenser may pass through the body tube before sliding down the slide portion. The solid items fall off of the distal slide end, for example, into a collecting tray.

17 Claims, 11 Drawing Sheets

(56) References Cited

U.S. PATENT DOCUMENTS

| | | | | |
|---|---|---|---|---|
| 8,360,270 | B1 | 1/2013 | McClosky et al. | |
| 8,714,405 | B2 | 5/2014 | Farnsworth et al. | |
| 8,870,024 | B2 | 10/2014 | Mendes et al. | |
| 9,501,626 | B2 | 11/2016 | Zhang et al. | |
| 2005/0236442 | A1* | 10/2005 | Kratzer | B65D 47/088 222/566 |
| 2006/0025884 | A1* | 2/2006 | Henkel | B65B 37/04 221/9 |
| 2012/0103985 | A1* | 5/2012 | Dwork | B65D 47/0866 220/254.1 |
| 2013/0240555 | A1 | 9/2013 | Kim | |
| 2014/0093344 | A1* | 4/2014 | Burton | A61J 7/02 414/675 |
| 2015/0266337 | A1* | 9/2015 | Abernethy, Jr. | B44D 3/128 222/570 |
| 2024/0190617 | A1* | 6/2024 | Gonzalez | B65B 37/10 |

OTHER PUBLICATIONS

"Tablet Chute," Natoli, (3 pages), (Year: 2022), (article, online), [Retrieved from the Internet Sep. 7, 2022] <URL: https://natoli.com/product/tablet-chute-6/>.

* cited by examiner

DISPENSING SPOUT FOR SOLID ITEMS

TECHNICAL FIELD

The present disclosure relates to a dispensing spout for secure engagement at an output of a dispenser.

BACKGROUND

Dispensers, such as the dispensers of automated pill counting machines used in pharmacies, have historically been characterized by high levels of product loss as products (e.g., pills) fall from a dispenser output opening into a collection tray and then bounce out of the tray.

BRIEF SUMMARY

The dispensing spout described in the present disclosure can engage with a dispenser to eliminate or at least minimize product loss as the products are dispensed from the dispenser. Various embodiments are directed to a dispensing spout that is configured to reduce the speed of products being dispensed, change the free fall trajectory of dispensed products, and/or reduce the free fall height of dispensed products. In some embodiments, the dispensing spout is configured to reduce the vertical distance of freefall for dispensed products from a dispenser, thereby reducing the chance for a dispensed product to bounce out of a receiving tray.

Generally, the dispensing spout described herein may include a body tube having an open mating end and an open dispensing end located opposite of the open mating end. The body tube may have a hollow interior that extends between the open mating end and the open dispensing end. The dispensing spout may further comprise a slide portion. The slide portion may slope away from the open dispensing end of the body tube to a distal slide end. The slide portion may further comprise a slide surface sloping away from the open dispensing end of the body tube between the side walls. The dispensing spout may further comprise a connection portion. The connection portion may define at least one engagement protrusion extending from the open mating end of the body tube. The at least one engagement protrusion may be configured to secure the dispensing spout to a dispenser.

In some embodiments, the slide portion of the dispensing spout may include sidewalls extending away from the open dispensing end of the body tube to the distal slide end. In such embodiments, the slide surface may slope away from the open dispensing end of the body tube between the sidewalls. In some embodiments, the body tube of a dispensing spout may include a first body tube portion connected with the slide portion. In some embodiments, the body tube of a dispensing spout may include a second body tube portion connected with the connection portion. In some embodiments, the first body portion may be detachably connectable with the second body tube portion The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described herein. Other features, aspects, and advantages of the subject matter will become apparent from the description, the drawings, and the claims.

BRIEF DESCRIPTION OF THE DRAWINGS

The description of the illustrative embodiments can be read in conjunction with the accompanying figures. It will be appreciated that, for simplicity and clarity of illustration, elements illustrated in the figures have not necessarily been drawn to scale, unless described otherwise. For example, the dimensions of some elements can be exaggerated relative to other elements, unless described otherwise. At times, like numeral are used across multiple figures. These like reference numerals refer to like parts throughout the multiple figures unless otherwise specified. Embodiments incorporating teachings of the present disclosure are shown and described with respect to the figures presented herein, in which.

DETAILED DESCRIPTION

Figure 1:
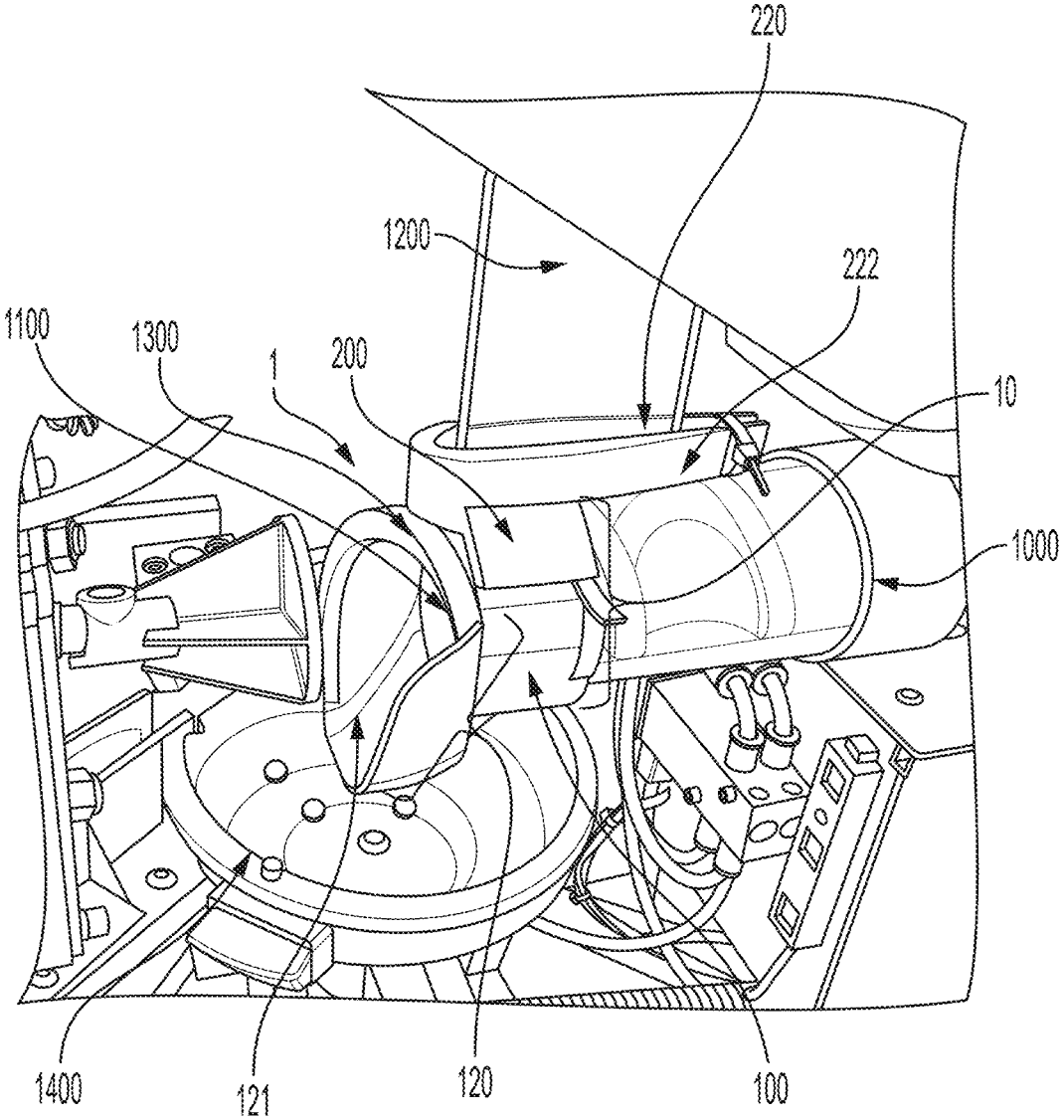
FIG. 1 illustrates a perspective view of a dispensing spout engaged with a dispenser in accordance with various embodiments.

Some embodiments are described in a more detailed manner hereinafter with reference to the accompanying drawings, in which some embodiments of the disclosure are shown. Reference numbers refer to like elements throughout the drawings. Embodiments may be embodied in different forms and should not be limited to the embodiments set forth herein. Rather, these embodiments are provided so that this disclosure will satisfy applicable legal requirements.

The components illustrated in the figures represent components that may be present in various embodiments of the present disclosure described herein. Certain components are optional, such that embodiments can include fewer or more components than those shown in the figures while not departing from the scope of the present disclosure. Some components can be omitted from one or more figures or shown in dashed line for visibility of the underlying components.

As used herein, terms such as "front," "rear," "top," etc. are used for explanatory purposes in the examples provided below to describe the relative positions of certain components or portions of components. As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. The use of such terms is inclusive of and is intended to allow independent claiming of specific values listed. Thus, use of any such aforementioned terms, or similarly interchangeable terms, should not be taken to limit the spirit and scope of embodiments of the present disclosure. As used in the specification and the appended claims, the singular form of "a," "an," and "the" include plural references unless otherwise stated. The terms "includes" and/or "including," when used in the specification, specify the presence of stated feature(s), element(s), and/or component(s); it does not preclude the presence or addition of one or more other features, steps, operations, elements, components, and/or groups thereof.

As used herein, the phrase "secure," "secured," and the like refer to the fact that the particular feature, structure, or characteristic following the phrase may mean detachably connected to a feature, structure, or characteristic and/or affixed/integrated to a feature, structure, or characteristic.

As used herein, the phrases "in one embodiment," "according to one embodiment," "in some embodiments," and the like generally refer to the fact that the particular feature, structure, or characteristic following the phrase may be included in at least one embodiment. Thus, the particular feature, structure, or characteristic may be included in more than one embodiment such that these phrases do not necessarily refer to the same embodiment.

The figures are not to limit the scope of this disclosure or the appended claims.

Various embodiments are embodied as a dispensing spout that may be securely attached at an output of a dispenser. In some embodiments, the dispensing spout reduces the speed of products dispensed from the dispenser (e.g., pills), changes the free fall trajectory of the dispensed products, and/or reduces the free fall height of the dispensed products exiting the dispenser outlet. Without the dispensing spout in place, products falling directly from the outlet of the dispenser into a collecting tray may bounce out of the collecting tray, such that the products (e.g., pills or other consumable products) cannot be provided to a consumer. The products exiting the outlet of the dispenser fall from too great of a height when dispensed directly from the outlet of the dispenser into the tray, such that the products have too great of a vertical velocity when the products hit the bottom surface of the collecting tray. Although this description focuses on pill dispensers, it should be understood that dispensing spouts discussed herein may be used with dispensers of other solid products (e.g., candy, stones, marbles, and/or the like).

The outlets of pill dispensers (and/or other product dispensers) are generally provided to avoid clogging of pills (e.g., with multiple pills lodged within the dispenser outlet such that pills are prevented from exiting the dispenser). However, this design consideration can create a large vertical distance between the outlet of the dispenser and a collecting tray. As mentioned above, this large vertical distance can cause some pills that freefall from the outlet into the collecting tray to bounce out of the collecting tray. The dispensing spout described herein decreases the vertical distance of freefall for pills exiting the dispenser without increasing the likelihood of pill jams at the dispenser outlet. The dispensing spout changes the trajectory of pills exiting the dispenser, as pills exit the dispenser and slide down a slide portion of the dispensing spout before falling into the collecting tray. Because the vertical distance between a distal end of the dispensing spout and the bottom surface of the collecting tray is reduced, pills falling from the dispenser hit the bottom surface of the collecting tray at a lower velocity, which decreases the likelihood that the pills will bounce out of the collecting tray.

Moreover, in some embodiments, the dispensing spout is configured for detachable engagement with the dispenser, such that the dispensing spout may be easily replaced, cleaned, or otherwise serviced. The dispensing spout may be attached to the dispenser, without modification to the dispensers. In one such embodiment, the dispensing spouts has a two-part design, whereby a first portion is connectable to the dispenser (e.g., via an attachment component) and a second portion is connectable to the first portion of the dispensing spout. In another such embodiment, a first portion (e.g., a top portion) of the dispensing spout comprises a connection portion defining at least one engagement protrusion (e.g., a pair of engagement protrusions collectively defining a clip) for engagement with the dispenser to detachably secure the dispensing spout to the dispenser, and a second portion (e.g., a bottom portion) of the dispensing spout comprises a slide portion sloping away from the dispensing spout to a distal end thereof. The second portion is connectable with the first portion, for example, by sliding the second portion onto a lower end of the first portion via an attachment mechanism integrated into the first portion and the second portion.

In some embodiments, the dispensing spout is integrated with the dispenser. Specifically, the dispensing spout may be integrated with an exit of the dispenser. The dispensing spout may be a single component having an integrated slide portion as discussed herein, such that products (e.g., pills), exiting the dispenser fall from a distal end of the slide portion. In other embodiments, the dispensing spout has a two-part design, whereby at least a first portion is integrated with the dispenser and a second portion is connectable to the first portion. Such a two-part design may enable maintenance of the dispensing spout (e.g., to facilitate cleaning of the dispenser and/or the dispensing spout), and/or to enable replacement of the second portion.

When secured relative to one another, the first portion and second portion of the dispenser spout define a body tube. An open mating end of the body tube rests against the dispenser when secured thereto such that products exiting the outlet of the dispenser pass through the body tube of the dispensing spout. The opposite, dispensing end of the dispensing spout defines the slide portion, such that products exit the body tube and slide down the slide portion before falling off of the distal end of the slide portion into a collecting tray. The slide portion is concave between sidewalls that converge toward the distal end, in certain embodiments, such that products are directed to fall from a predictable location on the distal end of the dispensing spout.

FIGS. 1-7 depict views of a dispensing spout 1 and portions thereof in accordance with various embodiments.

As shown in FIG. 1, the dispensing spout 1 may be secured to an outlet of an example dispenser 1000. When secured to the dispenser 1000, the dispensing spout 1 provides a predictable trajectory for products falling into the collecting tray 1400 by lowering the free fall height of products exiting the dispenser 1000. The dispensing spout 1 may also be configured to reduce the speed of the products exiting the dispenser 1000 through the application of a friction force as the products slide down the slide portion toward the distal end of the dispensing spout 1.

As shown in FIG. 1, the dispenser 1000 has an outlet opening 1100 and a connectable panel 1200 located above the outlet opening 1100. In many instances, the dispenser 1000 has these features when manufactured, such that the dispenser 1000 does not need to be modified to enable attachment of the dispensing spout 1. As shown, the dispensing spout 1 comprises a connection portion 220 configured to secure one or more components of the dispenser 1000 for easy installation. In various embodiments, the dispensing spout 1 comprises a body tube 10, wherein an open mating end 11 (e.g., depicted in FIG. 2B) of the body tube 10 is provided to contact one or more surfaces of the dispenser 1000 at least partially surrounding the dispenser's outlet opening 1100. The body tube 10 may be a single, unitary component, or the body tube 10 may be a multi-part component. The connection portion 220 extends from the body tube 10 (e.g., is integrally molded/formed with the body tube 10) and is configured to secure the body tube 10 to the dispenser 1000. In the illustrated embodiment of the figures, the connection portion 220 further comprises at least one engagement protrusion configured to secure the body tube 10 to the dispenser 1000. The at least one engagement protrusion is embodied as a pair of substantially parallel engagement arms 222, including a first engagement arm 222A and a second engagement arm 222B. In some embodiments, the dispensing spout 1 may be configured to be integrally fixed/secured with the dispenser 1000, wherein the dispensing spout 1 and dispenser 1000 may form one integrated unit.

Figure 4:
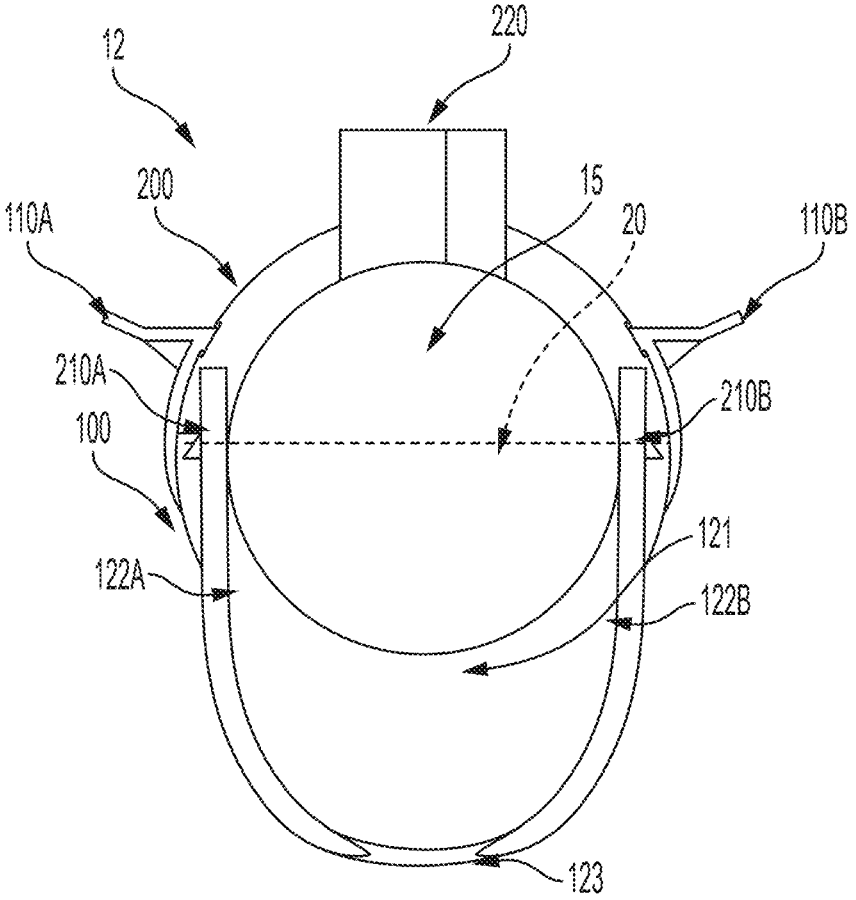
FIG. 4 illustrates a front view of a dispensing spout with a slide portion in accordance with various embodiments of the present disclosure.

In some embodiments, the dispensing spout 1 includes a slide portion 120 extending from a dispensing end 12 (e.g., depicted in FIG. 4, opposite the open mating end). The slide portion may be integrally formed with the body tube 10 or a portion thereof. The slide portion has a downward slope, beginning at the dispensing end 12 of the body tube 10 and extending downward to the distal end of the slide portion. Accordingly, the distal end of the slide portion is disposed lower than the hollow interior surface of the body tube 10. Moreover, the distal end of the slide portion is spaced a horizontal distance away from the dispensing end 12 of the body tube 10 (the horizontal distance being measured parallel to an axis extending through the body tube 10 between the open mating end and the dispensing end), such that the slide portion angles downward and away from the body tube 10 of the dispensing spout 1. In certain embodiments, the slide portion has a concave slope, such that the slope proximate the body tube 10 is steeper than the slope proximate the distal end.

Figure 7:
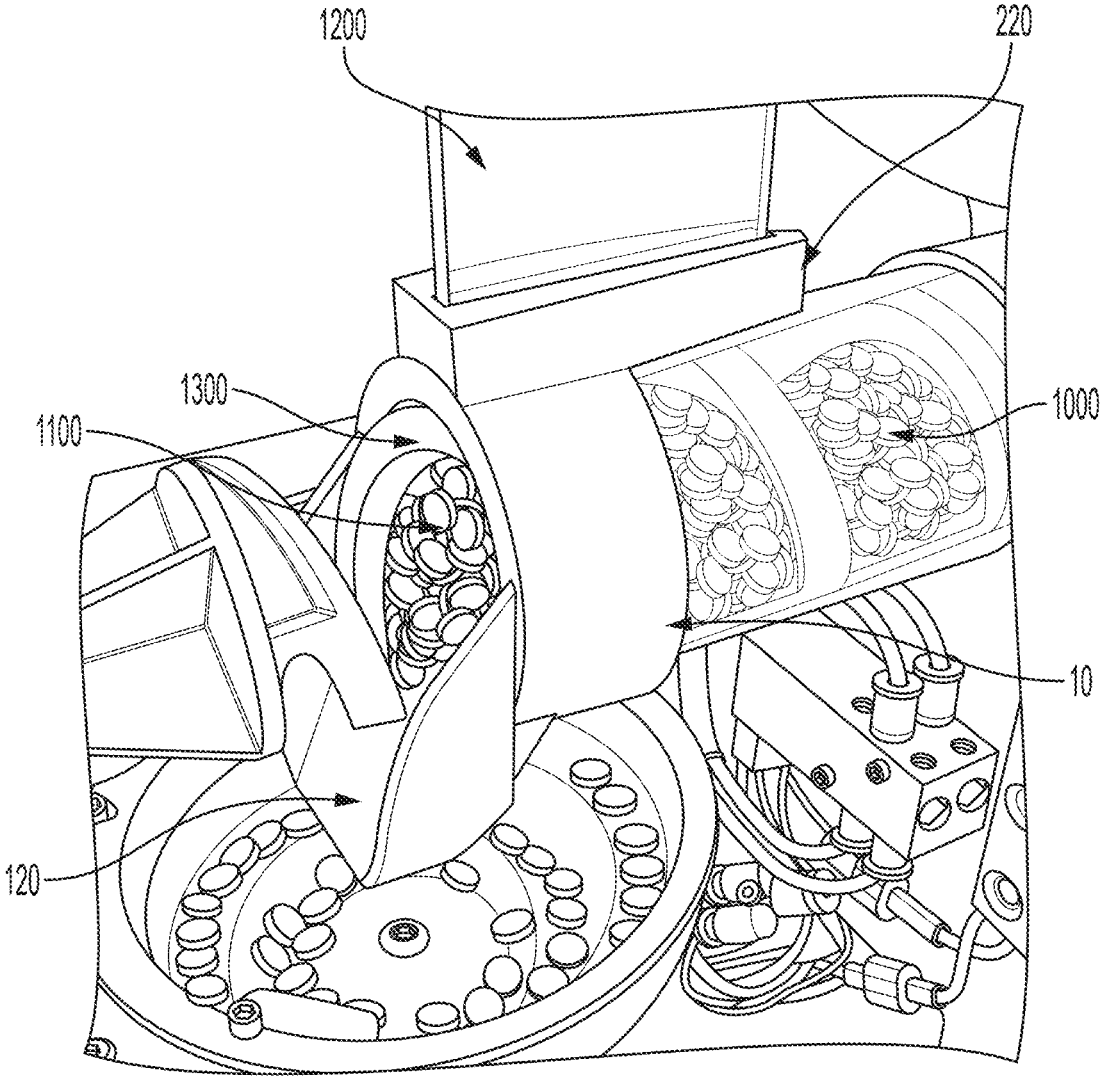
FIG. 7 illustrates a side perspective view of a spout engaged with the dispensing end of a dispenser in accordance with various embodiments of the present disclosure.

As products are dispensed, they travel through the body tube 10 and then slide down the slide portion before freefalling from the dispensing spout 1. In certain embodiments, one or more products may travel from a dispenser 1000 towards the outlet opening 1100 without touching the tube body 10. The one or more products may be stacked on top of one or more additional products that are being dispensed simultaneously (the one or more additional products are in contact with the tube body 10 while being dispensed as depicted in FIG. 7). In certain embodiments, the dispensing spout 1 is made of a plastic material having a smooth finish (e.g., a USDA-approved, food-grade plastic material). The properties of the material and finish of the plastic material (or other material) include a coefficient of friction, and products sliding down the slide portion are subject to frictional forces between the products and the surface of the slide portion. That frictional force may limit the speed of the products traveling down the slide portion.

With further reference to FIG. 1, the dispensing spout 1 secures to the connectable panel 1200 of the dispenser 1000 to position the dispensing spout 1 at the outlet opening 1100 of the dispenser 1000. The dispenser 1000 may further comprise an auger mechanism 1300 that extends out of the outlet opening 1100 and is configured to assist in the dispensing of products from the dispenser 1000 to the tray 1400. The dispensing spout 1 depicted in FIG. 1 comprises a first body tube portion 100 and a second body tube portion 200 that is connectable to the first body tube portion 100. This two-part configuration allows for easy installation around the outlet opening 1100, particularly where the auger mechanism 1300 extends beyond the outlet opening 1100. The second body tube portion 200 may be installed to securely engage the connectable panel 1200 and to partially surround the outlet opening 1100 (along a top portion of the outlet opening 1100). The first body tube portion 100 may slide onto and securely attach to the second body tube portion 200 along the bottom portion of the outlet opening 1100, such that the auger mechanism 1300 need not be removed from the dispenser 1000 to secure the dispending spout 1 onto the outlet opening 1100.

Figure 2A:
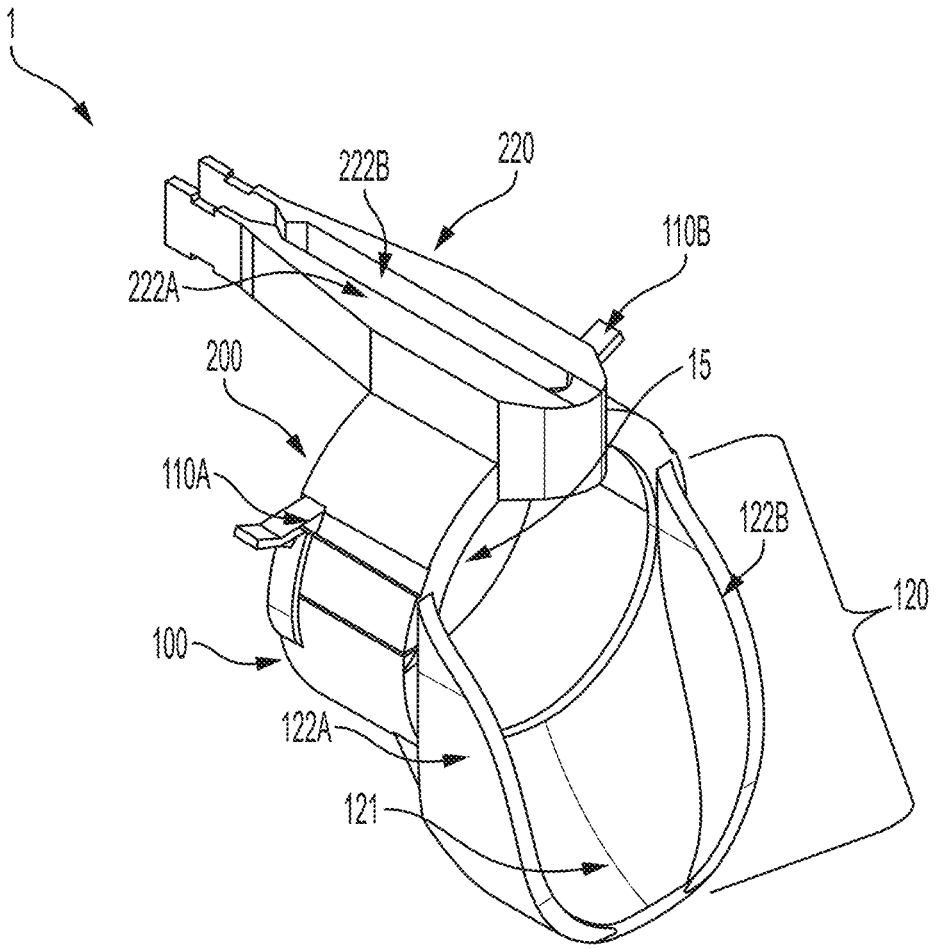
FIG. 2A illustrates a front perspective view of a dispensing spout in accordance with various embodiments of the present disclosure.
Figure 2B:
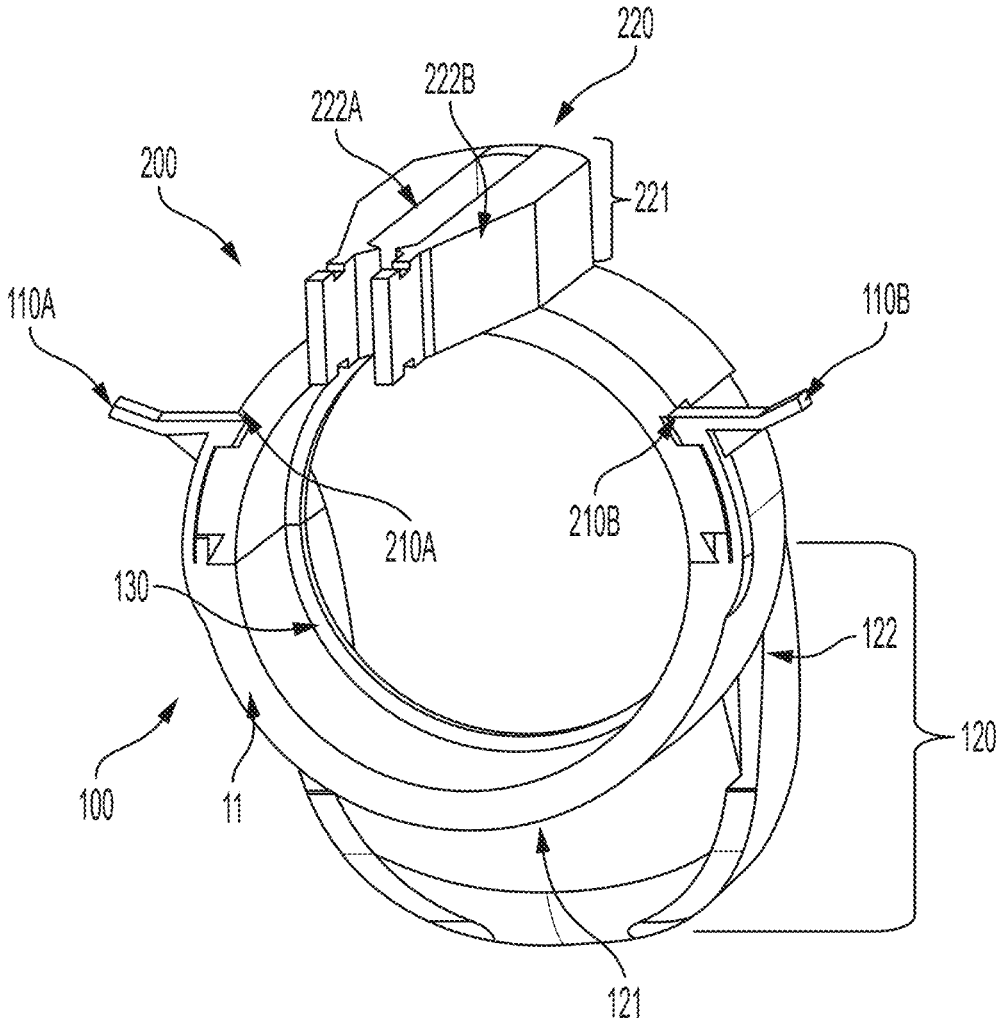
FIG. 2B illustrates a back view of a dispensing spout in accordance with various embodiments of the present disclosure.

FIGS. 2A-2B depict perspective views of an example dispensing spout 1. In the illustrated embodiment, a body tube 10 of the dispensing spout 1 defines an open mating end 11 (e.g., depicted in FIG. 2B) and an open dispensing end 12 (e.g., depicted in FIG. 4). In various embodiments, the open mating end 11 and the dispensing end 12 may be disposed on opposite ends of the body tube 10. As discussed, the open mating end 11 may be configured to contact one or more surfaces of the dispenser (not illustrated) surrounding the dispenser's outlet (not illustrated). As shown, the body tube 10 is embodied as a hollow cylinder with open ends, thereby defining a hollow interior 15 extending between the open mating end 11 and the dispensing end 12, such that products can flow through the body tube 10 to a slide portion. Although shown as a hollow cylinder, it should be understood that other shapes may be provided for the body tube 10, including oval-shaped, polygon-shaped, and/or the like. Moreover, in certain embodiments, the body tube 10 may be at least partially open (e.g., having an open top end). As shown, the hollow interior of the body tube 10 may have a cross-sectional shape that at least substantially matches the cross-sectional shape of the exterior of the body tube 10.

In various embodiments, the body tube 10 (and the dispensing spout 1 as a whole) encompasses at least two independent components that may be assembled to form the body tube 10. In the depicted embodiments, the dispensing spout 1 comprises a first body tube portion 100 and a second body tube portion 200. In various embodiments, providing the dispensing spout 1 in two independent and assemble components (e.g., first body tube portion 100 and the second body tube portion 200) facilitates installation of the dispensing spout 1 onto a dispenser 1000. In various embodiments, the first body tube portion 100 partially defines a portion of the hollow interior surface (e.g., the lower portion 130 (depicted in FIG. 6A) of the hollow interior surface). In various embodiments, the second body tube portion 200 partially defines a portion of the hollow interior surface (e.g., the upper portion 230 (depicted in FIG. 6C) of the hollow interior surface). The first body tube portion 100 and the second body tube portion 200 may define approximately equal percentages of the surface area of the hollow interior surface of the body tube 10. Said differently, the first body tube portion 100 may be at least substantially equal in size with the second body tube portion 200. However, in other embodiments, the first body tube portion 100 may be substantially larger or smaller than the second body tube portion 200.

For those embodiments that comprise at least a first body tube portion 100 and second body tube portion 200, each of these components comprise portions of a snap-on attachment mechanism, wherein the snap-on attachment mechanism may comprise attachment element 110 on the first body tube portion and receiving catch 210 on the second body tube portion. The snap-on attachment mechanism may be configured to detachably connect the first body tube portion 100 with the second body tube portion 200. The first body tube portion 100, in depicted embodiments, may include at least two attachment elements 110A, 110B (collectively "110"). In various embodiment, the at least two attachment elements 110 are disposed on opposite sides of the first body tube portion 100, wherein the at least two attachment elements 110 may be disposed in an attachment interface 130 (e.g., depicted in FIG. 6B) of the first body tube portion 100. In various embodiments, the at least two attachment elements 110 may elastically deflect, at least in part, from a first position (e.g., engaged position) to a second position (e.g., disengaged position), wherein the at least two attachment elements 110 may deflect when depressed by a user. The at least two attachment elements 110 may be biased to the first position. In one or more embodiments, the deflection of an attachment element 110 may cause the disengagement of one or more attachment elements 110 with a corresponding receiving catch of the second body tube portion 200 (e.g., receiving catch 210 shown in FIGS. 5, 6C, and 6D). Although FIGS. 2A-2B depicts the at least two attachment elements 110 associated with the first body tube portion 100 and the corresponding receiving catches 210 that are embodied as a feature of the second body tube portion 200, in some embodiments, the attachment interface may be reversed, with the at least two attachment elements 110 associated with the second body tube portion 200 without departing from the scope of the present disclosure.

With continued reference to FIGS. 2A-2B, the illustrated dispensing spout 1 comprises a slide portion 120 and a connection portion 220. As shown, the first body tube portion 100 includes the slide portion 120 and the second body tube portion 200 includes the connection portion 220. In some embodiments, the slide portion 120 extends between the hollow interior surface to a distal slide end 123 (e.g., depicted in FIG. 4), where products fall from the dispensing spout 1. In some embodiments, the slide portion 120 extends beneath the lowermost edge of the connection portion 220. As shown, the slide portion 120 is positioned on a lower portion of the body tube 10, opposite the connection portion 220, which is positioned on an upper portion of the body tube 10. Moreover, the slide portion 120 extends away from the dispensing end 12 of the body tube 10 and the connection portion 220 extends away from the open mating end 11 of the body tube 10. Moreover, the slide portion 120 comprises sidewalls 122A, 122B (collectively "122") on opposite sides of a slide surface 121. The sidewalls 122 each extend from the dispensing end 12 of the body tube 10 and converge toward the distal end of the slide portion 120. In certain embodiments, the sidewalls 122 are smoothly integrated with the slide surface along which products slide. In other embodiments, a sharp corner is defined between the slide surface and the sidewalls 122. In various embodiments, the sidewalls 122 may extend above an uppermost surface of the first body tube portion 100 to define a stop (e.g., a back surface of the sidewalls 122) against which the dispensing end 12 of the second body tube portion 200 contacts when the first body tube portion 100 is slid onto the second body tube portion 200.

Figure 3:
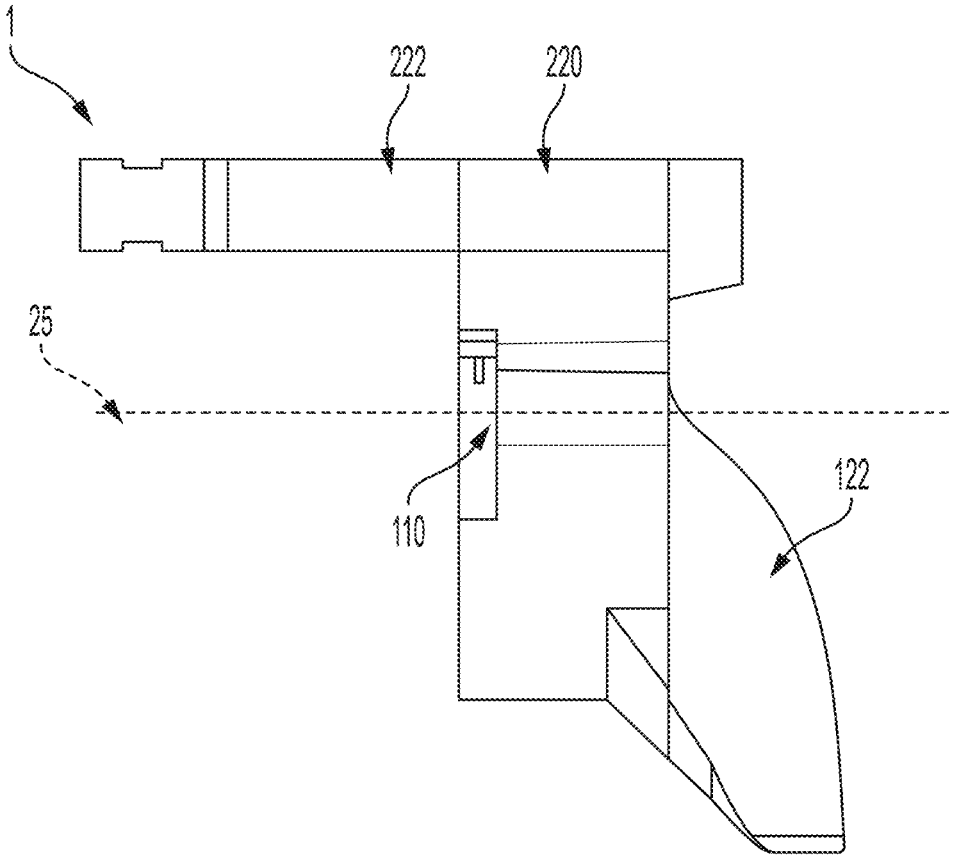
FIG. 3 illustrates a side view of a dispensing spout in accordance with various embodiments of the present disclosure.

FIG. 3 depicts a side view of an example dispensing spout 1. In the illustrated embodiment, the sidewalls 122 of the slide portion are configured to guide products down the entire length of the slide portion so that the products fall off of the distal end of the slide portion. Accordingly, the sidewalls 122 are sufficiently high as to prevent products from sliding off a side of the slide portion. The sidewalls 122 may define an open top of the slide portion, to prevent clogging of the slide portion with products. However, it should be understood that the slide portion may be defined as an enclosed tube in certain embodiments.

For those embodiments having an open top of the slide portion (as shown), the upper edge of the sidewalls may have a shape that at least substantially matches the contour of the slide surface. However, the upper edge of the sidewalls may have other shapes, such as having higher portions at known portions of the slide portion where products are more likely to fall off of the side of the slide portion. The sidewalls 122 are embodied as the same material (and may have the same surface finish) as the slide portion, and therefore the sidewalls 122 may apply a friction force on products that contact the sidewalls 122 while sliding down the slide surface 121 of the slide portion 120. In various embodiments, the slide portion may comprise two or more sidewalls 122A, 122B, as depicted in FIG. 2A, wherein a first sidewall 122A may be disposed on a first side of the slide surface 121 and a second sidewall 122B may be disposed on a second side of the slide surface 121. In certain embodiments, the sidewalls 122A, 122B are integrated as a part of the first body tube portion 100.

FIG. 4 depicts a front view of dispensing spout 1, which illustrates the downward sloping nature of the slide portion 120. As discussed, the body tube 10 may comprise at least two individual components (e.g., first body tube portion 100 and second body tube portion 200). Each component comprises a portion of an attachment mechanism 110, 210 which connects the first body tube portion 100 with the second body tube portion 200 at a division plane (schematically depicted as 20 in FIG. 4).

Moreover, as reflected in FIG. 4, the slide surface 121 may define a concave curve between the dispensing end 12 of the body tube 10 and the distal end of the slide portion 120. Thus, as mentioned previously, the slope of the slide surface 121 may change along its length. In various embodiments, the surface of the slide surface 121 may be smooth. In some embodiments, the surface of the concave slide surface 121 may define a texture pattern that is configured to slow the slide of products along its surface and/or to direct the products to slide toward the distal end of the slide surface. For example, the texture may be one or more grooves, ridges, bumps, and/or the like. Similarly, the sidewalls 122 may have a smooth surface or may be textured in a manner similar to the slide surface 121.

Because the slide portion 120 extends down and away from the dispensing end 12 of the body tube 10, products that slide down the slide portion 120 are directed to fall into a different location within the collecting tray as compared with products that exit a dispenser without a dispensing spout 1 attached thereto. Moreover, as discussed previously, the products exiting the distal end of the slide portion fall from a lower height into the tray, thereby reducing the likelihood of products bouncing out of the tray. In the illustrated embodiment, the slope at the distal end of the slide surface 121 is smaller (e.g., flatter) than the slope closer to the body tube 10 (which has a steeper slope). The relatively flat slope at the distal end of the slide surface 121 results in products exiting the distal end of the slide surface with a horizontal velocity component, such that the products do not fall vertically downward from the distal end of the slide portion, instead, products are away from distal slide end.

Figure 5:
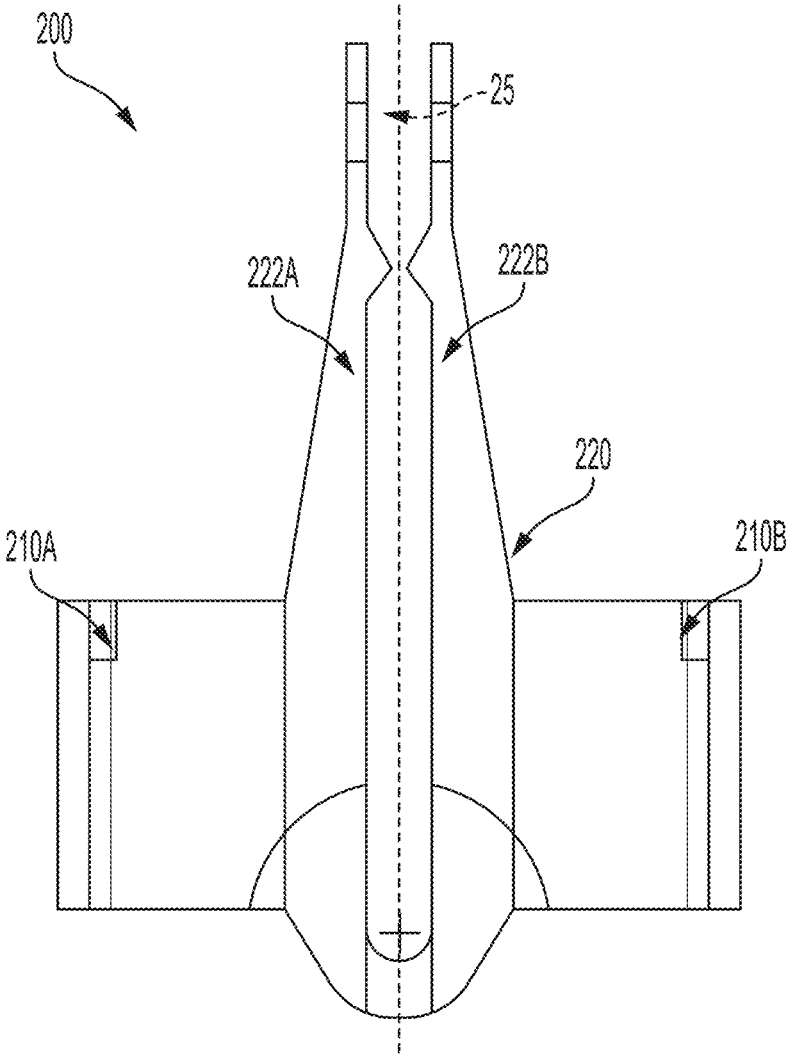
FIG. 5 illustrates a top perspective view of a second body tube portion with a connection portion in accordance with various embodiments of the present disclosure.

FIG. 5 depicts a second body tube portion 200 in accordance with various embodiments of the present disclosure. As discussed herein, the second body tube portion 200 may comprise a connection portion 220 configured to secure the dispensing spout 1 to a dispenser. In the illustrated embodiment, the connection portion 220 comprises at least two engagement arms 222A, 222B (collectively "222") that are configured to engage with a feature of the dispenser. In some embodiments, the engagement arms 222 may further include one or more grooves on each engagement arm. The one or more grooves may be disposed at the distal end of the engagement arms 222. The one or more grooves may allow for the dispensing spout 1 to lock onto the connectable panel 1200 of the dispenser 1000, for example, by attaching a cable tie or other fastener around the distal ends of the engagement arms 222, within the grooves thereof. As shown, the engagement arms 222 are at least substantially parallel to one another and extend parallel with a longitudinal axis 25 of the hollow interior of the body tube 10. The engagement arms extend beyond the open mating end 11 of the body tube 10. Each of the engagement arms 222 are integrally formed with an exterior surface of the second body tube portion 200 and are further connected to one another at a first end thereof 221. In various embodiments, the at least two engagement arms 222 may be configured to secure at least the second body tube portion 200 to the dispenser. As shown, second, distal ends of the engagement arms (at an opposite end from the first end) comprise one or more engagement features, such as grooves, detents, friction-fit features, interference fit features, and/or the like, Moreover, the engagement arms 222 may elastically deflect away from one another (deflecting from an engaged configuration to a disengaged configuration) when attaching to the dispenser, so that the engagement arms may snap around opposite sides of the feature of the dispenser and into the engaged position.

With further reference to FIG. 5, in various embodiments, the second body tube portion 200 may comprise at least two receiving catches 210A and 210B, each of which are configured to catch and snap into engagement with a corresponding attachment element 110 of the first body tube portion 100.

FIGS. 6A-6D illustrate an example snap-on attachment mechanism 110, 210 for attaching a first body tube portion 100 with a second body tube portion 200 of a dispensing spout 1. With reference to FIGS. 6A-6D, in various embodiments, the first body tube portion 100 may comprise at least two attachment elements 110A and 110B (collectively referred to as "110"). The at least two attachment elements 110 of the snap-on attachment mechanism may be in the form of snaps, magnets, clamps, and/or the like, wherein the at least two attachment elements 110 engage with corresponding receiving catches of the second body tube portion 200. Specifically in the illustrated embodiment, the attachment elements 110 are configured to deflect to provide an interference-type or snap-in style attachment between the first body tube portion 100 and the second body tube portion 200. Accordingly, the attachment elements 110 are configured to elastically deflect from a first position (e.g., engaged position) to a second position (e.g., disengaged position). The attachment elements 110 may be biased to the first position, and the attachment elements 110 may elastically deflect when depressed by a user. In one or more embodiments, the first attachment element 110A may deflect independently from the second attachment element 110B. As depicted in FIGS. 6A-6D, the first attachment element 110A may be disposed on a first side, and the second attachment element 110B may be disposed on a second side of the first body tube portion 100. In some embodiments, the first attachment element 110A may be disposed linearly opposite of the second attachment element 110B, on a second side of the first body tube portion 100. In various embodiments, the at least two attachment elements 110 disposed parallel to each other may define the attachment interface 130 of the first body tube portion.

Figure 6A:
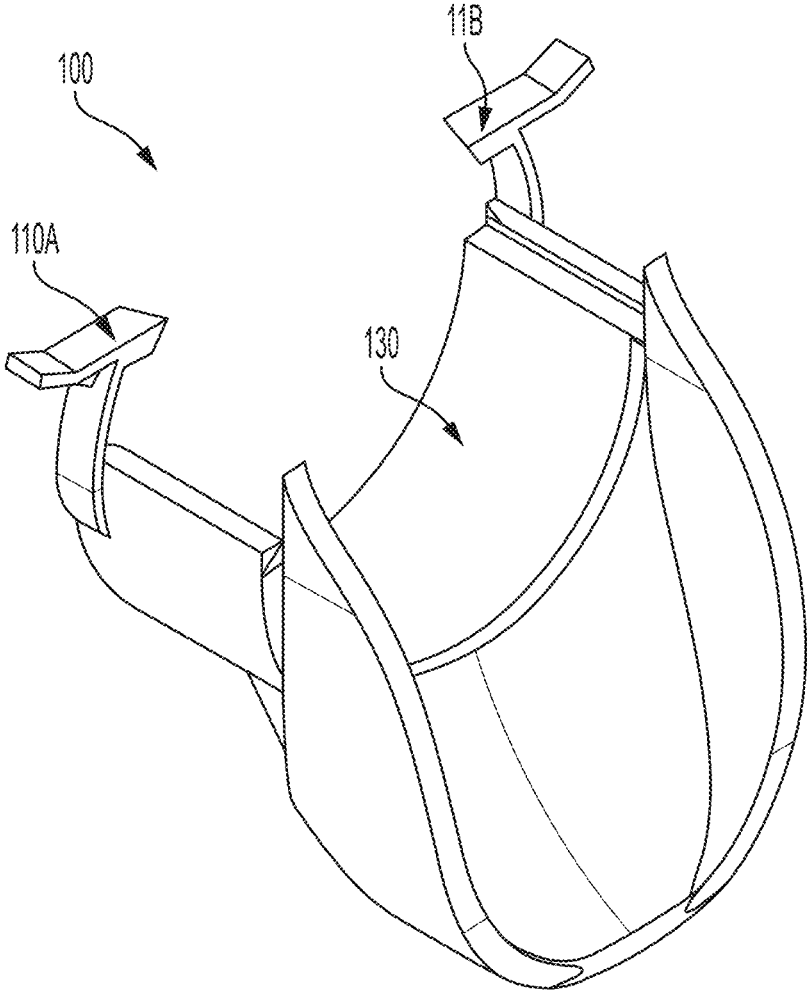
FIG. 6A illustrates a side perspective view of a first body tube portion in accordance with various embodiments of the present disclosure.
Figure 6B:
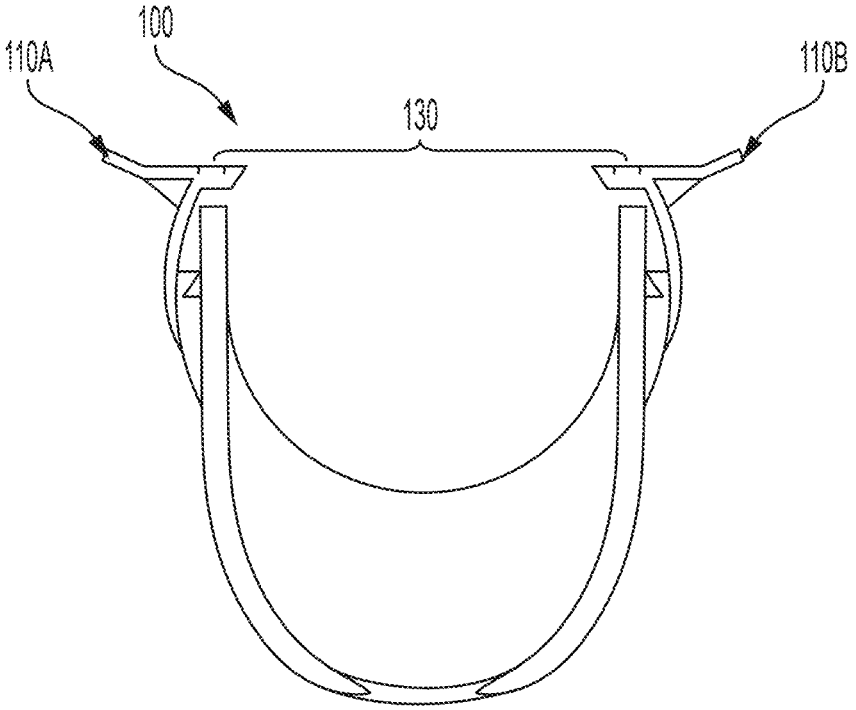
FIG. 6B illustrates a front view of a first body tube portion in accordance with various embodiments of the present disclosure.
Figure 6C:
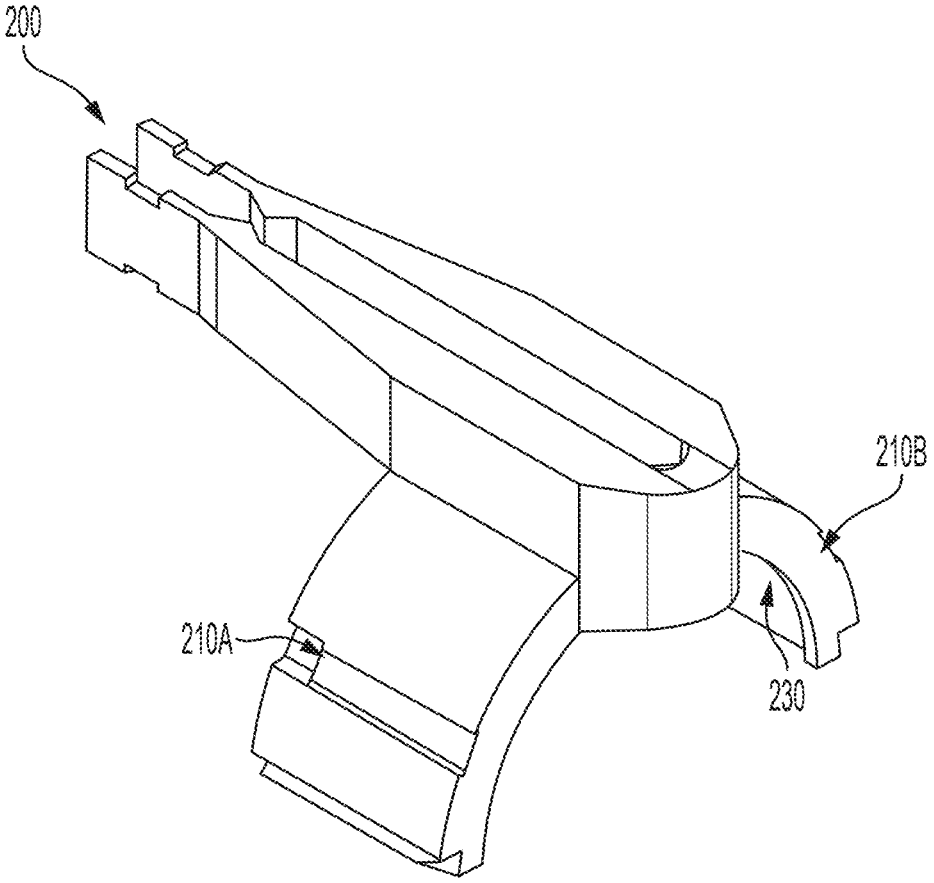
FIG. 6C illustrates a side perspective view of a second body tube portion in accordance with various embodiments of the present disclosure.

With reference to FIG. 6C, the second body tube portion 200 may comprise at least two receiving catches 210A and 210B (collectively referred to as "210"). The at least two receiving catches 210 may be configured to engage with and/or secure with the corresponding attachment elements 110 of the first body tube portion 100. The at least two receiving catches 210 of the snap-on attachment mechanism may be in the form of snaps, slots, magnets, engagement surfaces, and/or the like. In various embodiments, the at least two receiving catches 210 may secure the second body tube portion 200 to the first body tube portion 100 when the attachment elements 110 are in the corresponding engaged positions, wherein the attachment elements 110 may be engaged with and/or securely connected with the receiving catches 210. In one or more embodiments, a first receiving catch 210A may be disposed on a first side, and a second receiving catch 210B may be disposed on a second side of the second body tube portion 200. In some embodiments, the first receiving catch 210A may be disposed linearly opposite of the second receiving catch 210B. In certain embodiments, the receiving catches 210 may each be disposed adjacent the open mating end 11 of the body tube 10. A guide slot may extend from each of the receiving catches 210 to the dispensing end 12 of the body tube 10. The guide slot may have a height at least substantially equal to a height of the receiving catches 210, however the guide slot may have a shallower depth than the body tube 10, such that the attachment elements 110 snap into the engaged configuration when the first body tube portion 100 is fully engaged with the second body tube portion 200 (to collectively define the body tube 10). In various embodiments, the guide slot associated with the first receiving catch 210A is parallel to the guide slot associated with the second receiving catch 210B.

Figure 6D:
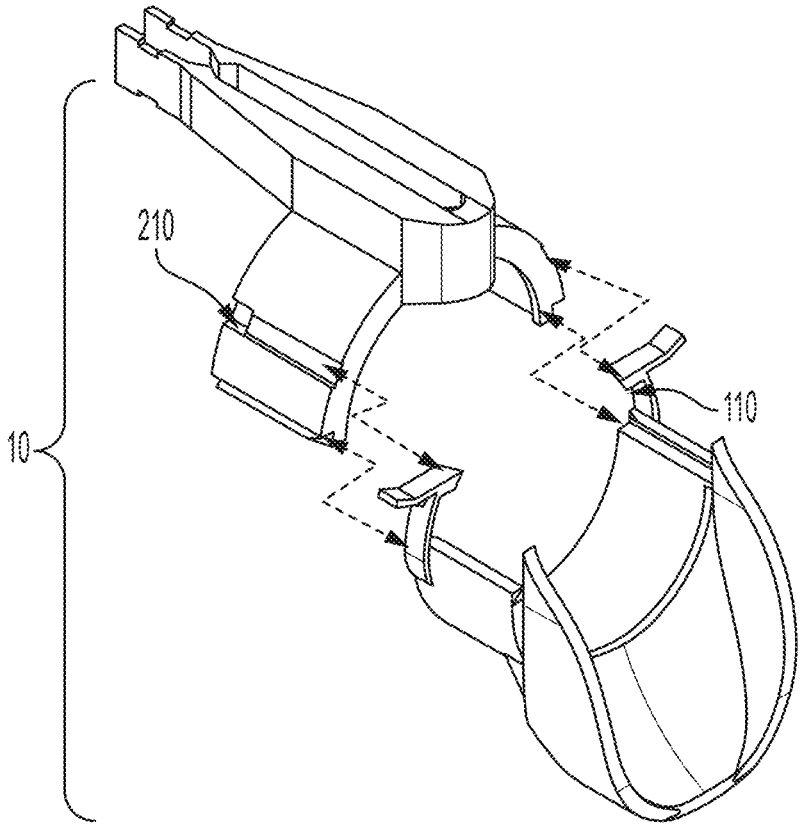
FIG. 6D illustrates a side perspective view of an exploded view of a dispensing spout in accordance with various embodiments of the present disclosure.

With reference to FIG. 6D (and as also visible in FIG. 2B), the first body tube portion 100 may slide into engagement with the second body tube portion 200. A top edge of the first body tube portion 100 may define a stepped (or other shaped) top edge, that is configured to engage with a corresponding shape bottom edge of the second body tube portion 200. In certain embodiments, the corresponding shapes of the edges of the first and second body tube portions are configured to enable sliding of the first body tube portion 100 relative to the second body tube portion 200, but to prevent lifting of the second body tube portion 200 vertically away from the first body tube portion 100. Accordingly, to assemble the first and second body tube portions, the first body tube portion 100 is slid along a bottom edge of the second body tube portion 200, while the attachment elements 110 slide along guide slots of the second body tube portion 200. Once the first body tube portion 100 is fully engaged with the second body tube portion 200 (e.g., a dispensing end 12 of the second body tube portion 200 contacts a rear surface of the sidewalls 122 of the slide portion of the first body tube portion 100), the attachment elements 110 snap into corresponding receiving catches 210 of the second body tube portion 200 to detachably lock the first and second body tube portions relative to one another. Specifically, sliding in a first direction is prevented by the rear surface of the sidewalls of the slide portion blocking relative movement of the second body tube portion 200, and sliding in an opposite second direction is prevented by the attachment elements 110 contacting edges of the corresponding catches 210 of the second body tube portion 200. It should be understood that other attachment mechanisms may be used for connecting the first body tube portion 100 with the second body tube portion 200. For example, the first body tube portion 100 may magnetically connect to the second body tube portion 200, may clamp onto the second body tube portion 200, and/or the like.

To attach the dispensing spout 1 to a dispenser, the connection portion 220 of the second body tube portion 200 may be attached to the dispenser 1000 while the first body tube portion 100 and second body tube portion 200 are separated. The engagement arms of the connection portion 220 are secured to the connectable panel 1200 of the dispenser 1000 with the hollow interior surface of the second body tube portion 200 aligned with an uppermost edge of the outlet opening 1100 of the dispenser 1000. Once the second body tube portion 200 is attached to the dispenser 1000, the first body tube portion 100 is slid onto the second body tube portion 200, specifically, with the corresponding slidable features of the top surface of the first body tube portion 100 engaging in sliding contact with the slidable features of the bottom surface of the second body tube portion 200 until the rear surface of the sidewalls of the slide portion (on the first body tube portion 100) contact the dispensing end 12 of the second body tube portion 200. Simultaneously, the attachment elements 110 of the first body tube portion 100 slide along the corresponding guide slots of the second body tube portion 200 until the attachment elements 110 engage the receiving catches 210 (occurring at least substantially simultaneously with the back surface of the sidewalls of the slide portion engaging the second body tube portion 200).

Connecting the first body tube portion 100 with the second body tube portion 200 defines the entirety of the dispensing spout 1 and positions the dispensing spout 1 around the outlet of the dispenser to allow pills to flow from the outlet of the dispenser, through the open mating end 11 of the dispensing spout 1 and out the dispensing end 12 of the dispensing spout 1, where the pills move down the slide surface before falling into the collecting tray. In some embodiments, the hollow interior surface may align symmetrically with the outlet opening 1100, wherein the body tube 10 sits flush with the outermost edges of the outlet opening (e.g., body tube 10 does not obstruct the flow of the pills).

FIG. 7 illustrates an example dispensing spout secured with a dispenser in accordance with various embodiments. In the illustrated embodiment of FIG. 7, the dispensing spout 1 is a single piece component that is attachable at the outlet opening 1100 of the dispenser 1000. In embodiments where an auger 1300 extends out of the outlet opening 1100 of the dispenser 1000, the auger 1300 may be removed to enable installation of the dispensing spout 1 by sliding the dispensing spout 1 onto the outlet opening 1100 (and causing the connecting portion 2200 to slide around the connectable panel 1200). The auger 1300 may then be reassembled onto the dispenser 1000 after attachment of the dispensing spout 1.

Many modifications and other embodiments of the present disclosure set forth herein will come to mind to one skilled in the art to which these embodiments pertain having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A dispensing spout comprising:

a body tube comprising a first body tube portion and a second body tube portion;

a slide portion sloping away from an open dispensing end of the first body tube portion, wherein the slide portion comprises (a) sidewalls extending away from the open dispensing end of the first body tube portion and (b) a slide surface sloping away from the open dispensing end of the first body tube portion between the sidewalls; and a connection portion connected with the second body tube portion, and defining at least one engagement protrusion configured to secure the dispensing spout to a pill dispenser; and wherein the first body tube portion is detachably connectable to the second body tube portion.

2. The dispensing spout according to claim 1, wherein the first body tube portion and the second body tube portion are configured to engage via a snap-on attachment mechanism.

3. The dispensing spout according to claim 2, wherein the first body tube portion further comprises a first portion of the snap-on attachment mechanism comprising:

at least two attachment elements are disposed at a first attachment interface of the first body tube portion.

4. The dispensing spout according to claim 3, wherein the second body tube portion further comprises a second portion of the snap-on attachment mechanism comprising:

at least two receiving catches disposed at a second attachment interface of the second body tube portion and configured to engage with the at least two attachment elements of the first body tube portion.

5. The dispensing spout according to claim 1, wherein the slide portion defines a concave surface.

6. The dispensing spout according to claim 5, wherein a slope of the concave surface begins at a hollow interior surface of the first body tube portion.

7. The dispensing spout according to claim 5, wherein the sidewalls have a curvature matching the concave surface.

8. The dispensing spout according to claim 1, wherein the dispensing spout comprises a plastic material.

9. The dispensing spout of claim 1, wherein the first body tube portion slides relative to the second body tube portion.

10. The dispensing spout of claim 1, wherein the at least one engagement protrusion comprises a first engagement arm and a second engagement arm.

11. The dispensing spout of claim 10, wherein the first engagement arm and the second engagement arm each define grooves configured for locking the dispensing spout onto a component of the pill dispenser.

12. The dispensing spout of claim 1, wherein the body tube is configured to accept an auger extending into the pill dispenser.

13. A dispensing spout comprising:

a body tube;

a slide portion sloping away from an open dispensing end of the body tube, wherein the slide portion comprises (a) sidewalls extending away from the open dispensing end of the body tube and (b) a slide surface sloping away from the open dispensing end of the body tube between the sidewalls; and a connection portion extending from an external surface of the body tube and defining at least one engagement protrusion configured to secure the dispensing spout to a pill dispenser;

wherein the at least one engagement protrusion comprises:

a first engagement arm and a second engagement arm, wherein the first engagement arm and the second engagement arm are configured to clip onto opposing sides of a component of the pill dispenser.

14. The dispensing spout according to claim 13, wherein the first engagement arm and the second engagement arm comprise locking features configured to self-lock with the component of the pill dispenser.

15. The dispensing spout according to claim 14, wherein the at least one engagement protrusion extends parallel with a longitudinal axis of the body tube, wherein the longitudinal axis extends perpendicular to the open dispensing end.

16. The dispensing spout of claim 13, wherein the first engagement arm and the second engagement arm each define grooves configured for locking the dispensing spout onto the component of the pill dispenser.

17. The dispensing spout of claim 13, wherein the body tube is configured to accept an auger extending into the pill dispenser.

* * * * *